US005352141A

United States Patent [19]

Shields et al.

[11] Patent Number: 5,352,141

[45] Date of Patent: Oct. 4, 1994

[54] MARINE DRIVE WITH DUAL PROPELLER EXHAUST AND LUBRICATION

[75] Inventors: Waylon D. Shields; Woody R. Smith, both of Stillwater; Steven J. Pavey, Carney, all of Okla.

[73] Assignee: Brunswick Corporation, Lake Forest, Ill.

[21] Appl. No.: 69,162

[22] Filed: May 28, 1993

[51] Int. Cl.[5] ..... B63H 5/10

[52] U.S. Cl. ..... 440/80; 416/129; 416/93 A; 440/89

[58] Field of Search ..... 440/79, 80, 81, 83, 440/89; 416/93 A, 93 M, 129 R, 129 A, 128

[56] References Cited

U.S. PATENT DOCUMENTS

| | | | |
|---|---|---|---|
| 2,948,252 | 8/1960 | Alexander, Jr. | 416/93 A |
| 3,931,783 | 1/1976 | Croisant | 123/196 W |
| 4,373,922 | 2/1983 | Weed | 440/89 |
| 4,529,387 | 7/1985 | Brandt | 440/66 |
| 4,604,032 | 8/1986 | Brandt et al. | 416/128 |
| 4,619,584 | 10/1986 | Brandt | 416/129 |
| 4,630,719 | 12/1986 | McCormick | 192/21 |
| 4,679,682 | 7/1987 | Gray, Jr. et al. | 192/21 |
| 4,698,036 | 10/1987 | Brandt | 440/62 |
| 4,741,670 | 5/1988 | Brandt | 416/129 |
| 4,764,135 | 8/1988 | McCormick | 440/83 |
| 4,773,215 | 9/1988 | Winberg et al. | 60/324 |
| 4,790,782 | 12/1988 | McCormick | 440/61 |
| 4,793,773 | 12/1988 | Kinouchi et al. | 416/129 A |
| 4,795,382 | 1/1989 | McCormick | 440/81 |
| 4,832,635 | 5/1989 | McCormick | 440/78 |
| 4,832,636 | 5/1989 | McCormick | 440/80 |
| 4,840,136 | 6/1989 | Brandt | 440/78 |
| 4,869,121 | 9/1989 | Meisenburg | 74/323 |
| 4,869,694 | 9/1989 | McCormick | 440/83 |
| 4,871,334 | 10/1989 | McCormick | 440/89 |
| 4,897,058 | 1/1990 | McCormick | 440/80 |
| 4,900,281 | 2/1990 | McCormick | 440/78 |
| 4,948,384 | 8/1990 | Bland et al. | 440/78 |

*Primary Examiner*—Sherman Basinger
*Attorney, Agent, or Firm*—Andrus, Sceales, Starke & Sawall

[57] ABSTRACT

A marine drive (10) has a spool (36) positioned in the lower horizonal bore (28) and supporting a dual propeller shaft assembly (38, 40). An exhaust passage (130) includes a passage (132) in the drive housing (26) communicating with the horizontal bore (28) at the spool (36), and a spool exhaust passage (134) passing exhaust rearwardly through the spool to the propeller through-hub exhaust passages (136, 138), providing through-hub exhaust through dual propellers (12, 14). An oil passage (152) in the housing (26) communicates with the horizontal bore (28) forwardly of the exhaust passage (132) and lubricates the dual propeller shaft assembly.

16 Claims, 4 Drawing Sheets

FIG. 4
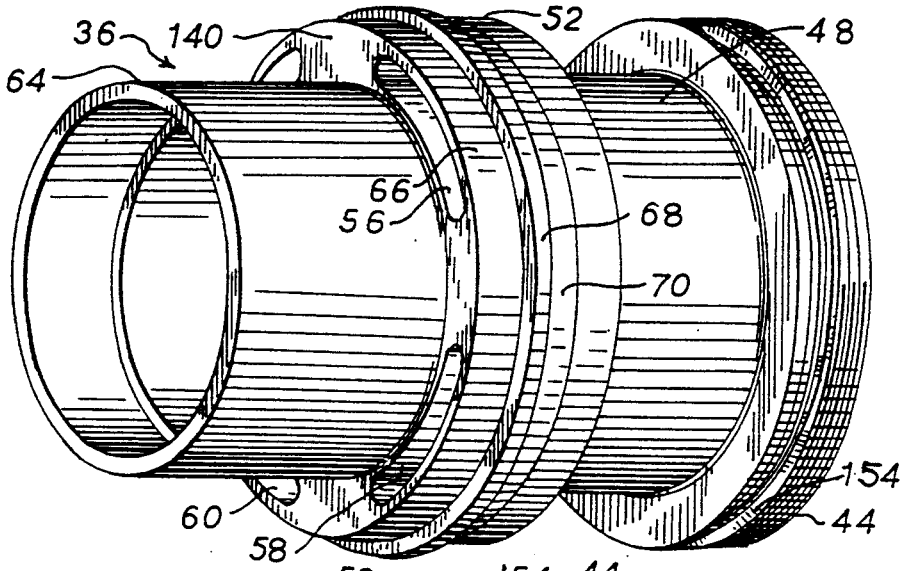
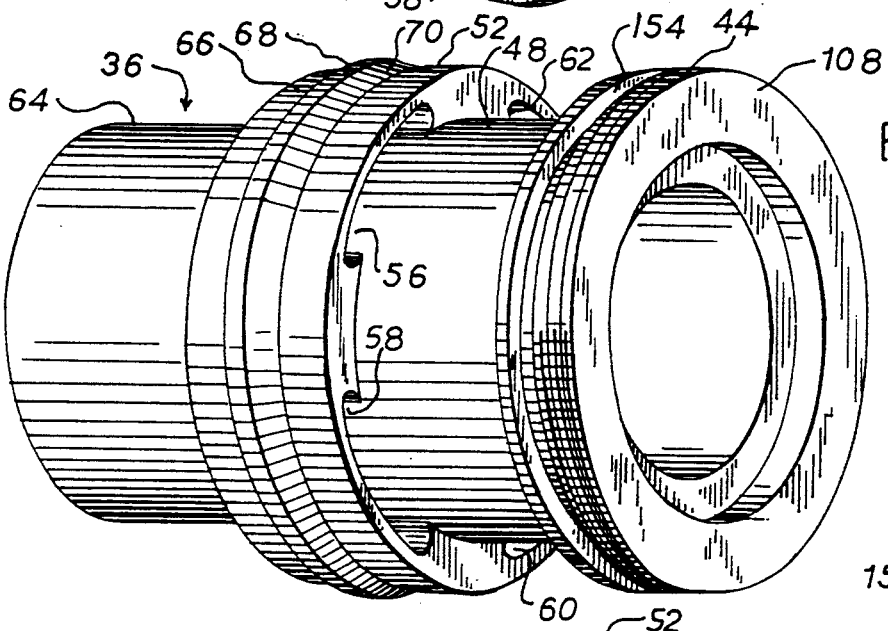
FIG. 5
FIG. 6
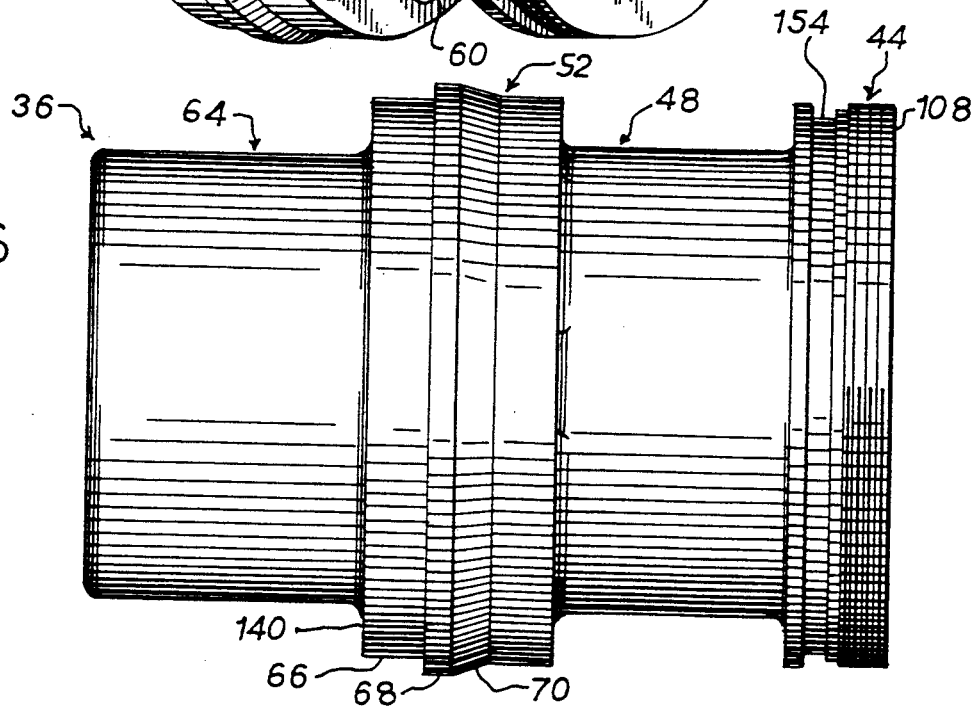

MARINE DRIVE WITH DUAL PROPELLER EXHAUST AND LUBRICATION

BACKGROUND AND SUMMARY

The invention relates to a marine drive having dual counter-rotating coaxial propellers.

Dual propeller marine drives with concentric counter-rotating propeller shafts are known in the prior art. The present invention provides improvements thereover, particularly in performance and durability.

In one aspect of the invention, cavitation of the propellers is provided by through-propeller-hub exhaust structure which is simple and rugged. An exhaust passage in the drive housing communicates with the lower horizontal bore in the torpedo of the housing. The exhaust passage communicates with the bore at the bearing carrier spool which supports the dual propeller shaft assembly. A passage through the spool passing exhaust rearwardly therethrough. The spool is provided by a cylindrical member having a first outer diameter portion engaging the housing within the horizontal bore, a second reduced outer diameter portion within the horizontal bore and aft of the first outer diameter portion and defining an annular recess receiving exhaust from the first exhaust passage in the drive housing, a third outer diameter portion aft of the second outer diameter portion and engaging the housing and having a plurality of slots extending rearwardly therethrough, and a fourth reduced outer diameter portion aft of the third outer diameter portion and external of the horizonal bore, such that exhaust from the annular recess flows rearwardly through the slots through the third outer diameter portion then rearwardly through the propeller hubs.

In another aspect, oil passage structure is provided for lubricating the dual propeller shaft assembly. An oil passage is provided by another passage in the drive housing, which passage communicates with the lower horizontal bore forwardly of the exhaust passage. The passages are sealed from each other by the spool which has an annular seal engaging the housing within the horizontal bore at a location axially between the passages. The spool is thread mounted within the horizontal bore. A locking ring is thread mounted in the horizontal bore and is tightened against a tapered roller thrust bearing supporting the driven gear on the outer propeller shaft engaged by the pinion gear of the vertical drive shaft. The threaded locking ring is spaced forwardly of the forward end of the carrier spool by an axial gap. The oil passage in the housing communicates with the horizontal bore at the axial gap and lubricates the dual propeller shaft assembly, including a bearing between the outer propeller shaft and the spool, and a bearing between the inner and outer propeller shafts.

The invention further relates to commonly owned copending allowed application Ser. No. 07/889,530, filed May 27, 1992, U.S. Pat. No. 5,249,995, allow application Ser. No. 07/889,495, filed May 27, 1992, U.S. Pat. No. 5,230,644, and allowed application Ser. No. 07/892,399, filed May 28, 1992, U.S. Pat. No. 5,236,380, incorporated herein by reference, and to application Ser. No. 08/069,163, filed on even date herewith and which is a continuation-in-part of the present application.

BRIEF DESCRIPTION OF THE DRAWINGS

FIG. 4 is a perspective view of the spool of FIG. 3.

FIG. 5 is another perspective view of the spool of FIG. 4.

FIG. 6 is a side elevation view of the spool of FIGS. 4 and 5.

DETAILED DESCRIPTION

Figure 1:
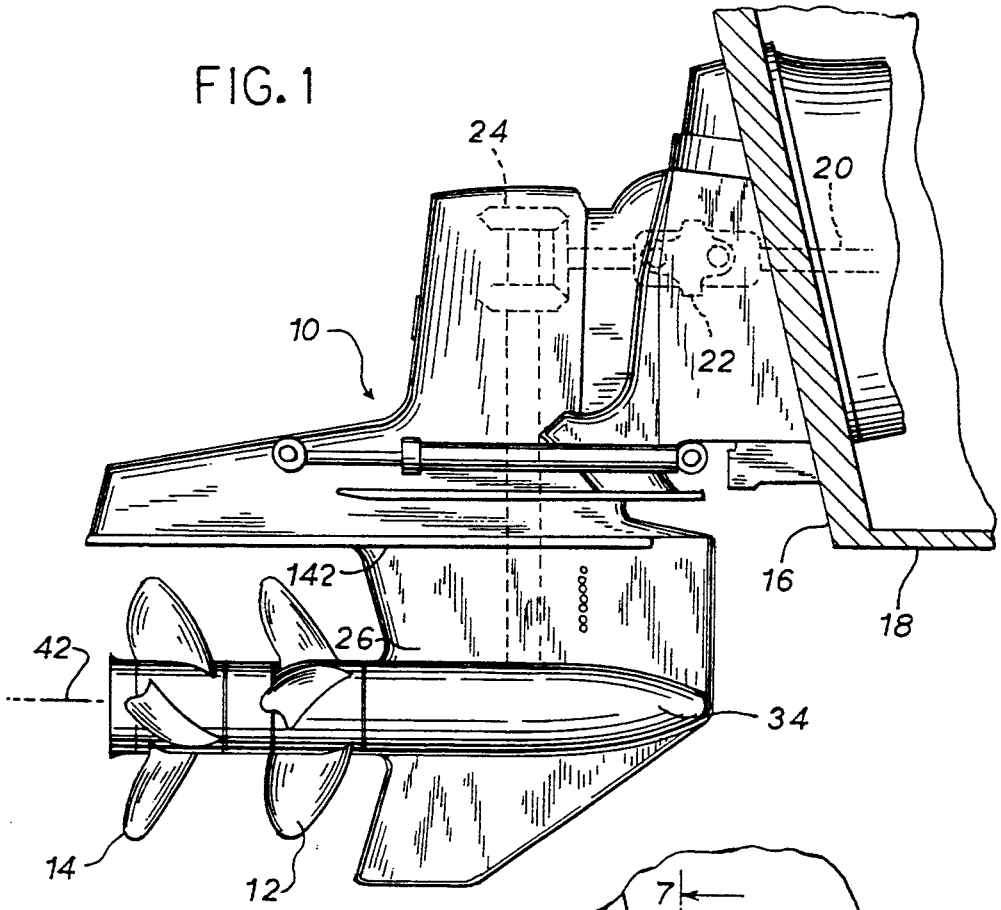
FIG. 1 is a side elevation view of a marine drive in accordance with the invention.

FIG. 1 shows a marine drive 10 having two counter-rotating propellers 12 and 14. The drive is mounted to the transom 16 of a boat 18 according to the usual marine stern drive mounting arrangement. An input shaft 20 is driven by an engine (not shown) in the boat. 18. Input shaft 20 is coupled through a universal joint 22 to an upper gear and clutch mechanism 24 which is known in the art, as shown in U.S. Pat. Nos. 4,630,719, 4,679,682, and 4,869,121, incorporated herein by reference. Universal joint 22 allows trimming and steering of the drive. Drive housing 26 has a lower horizontal bore 28, FIG. 2, and an intersecting vertical bore 30 therein. Upper gear mechanism 24 drives a vertical drive shaft 32, as shown in incorporated U.S. Pat. No. 4,869,121, positioned in vertical bore 30. Horizontal bore 28 is in the portion of the drive housing called the torpedo 34, FIG. 1.

A spool 36, FIGS. 2–6, is positioned in horizontal bore 28 and supports a dual propeller shaft assembly, including a hollow outer propeller shaft 38 positioned in spool 36, and an inner propeller shaft 40 positioned in outer propeller shaft 38. The inner and outer propeller shafts are concentric and rotate in opposite rotational directions along a common axis 42. Spool 36 is a cylindrical member having a forward first outer diameter portion 44, FIG. 6, threadingly engaging housing 26 within horizontal bore 28 at thread set 46, FIG. 3. The spool includes a second reduced outer diameter portion 48, FIG. 6, within horizontal bore 28, FIGS. 2 and 3, and aft of first outer diameter portion 44, FIG. 6, and defining an annular recess 50, FIGS. 2 and 3. Spool 36 includes a third outer diameter portion 52, FIG. 6, aft of second outer diameter portion 48 and engaging drive housing 26 at the aft end 54, FIG. 3, of horizontal bore 28. Third outer diameter portion 52 has a plurality of slots 56, 58, 60, 62, FIGS. 3–5 and 7, extending rearwardly therethrough. Spool 36 has a fourth reduced outer diameter portion 64 aft of third outer diameter portion 52 and external of horizontal bore 28.

Figure 3:
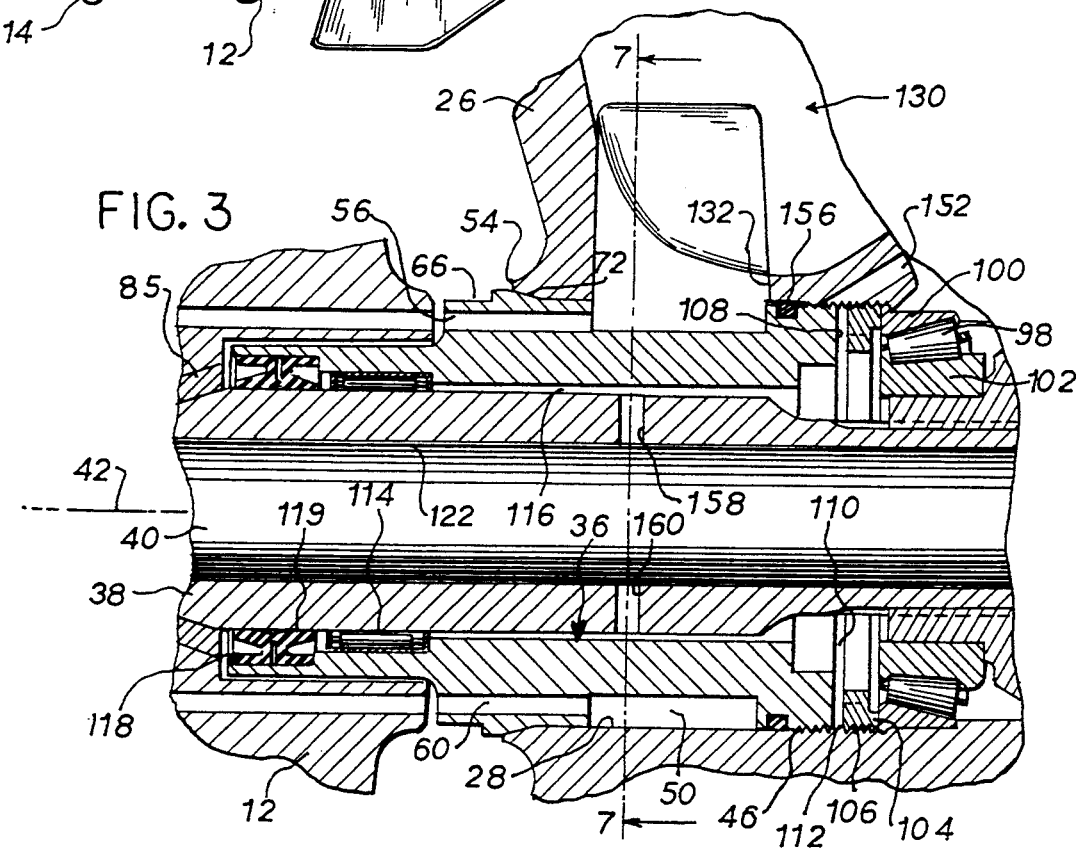
FIG. 3 is an enlarged partial sectional view of a portion of the structure of FIG. 2.

Third outer diameter portion 52 of spool 36 extends rearwardly at 66, FIGS. 6 and 3, externally of horizontal bore 28. Third outer diameter portion 52 includes a raised annular shoulder 68 of outer diameter greater than the inner diameter of horizontal bore 28 and engaging housing 26 at aft end 54 of horizontal bore 28. Raised annular shoulder 68 has a forward portion 70, FIG. 6, tapered forwardly to reduced outer diameters.

Horizontal bore 28 at aft end 54 is tapered at 72, FIG. 3, rearwardly to increasing inner diameters and snugly engages forward tapered portion 70 of raised annular shoulder 68 in flush relation.

Figure 2:
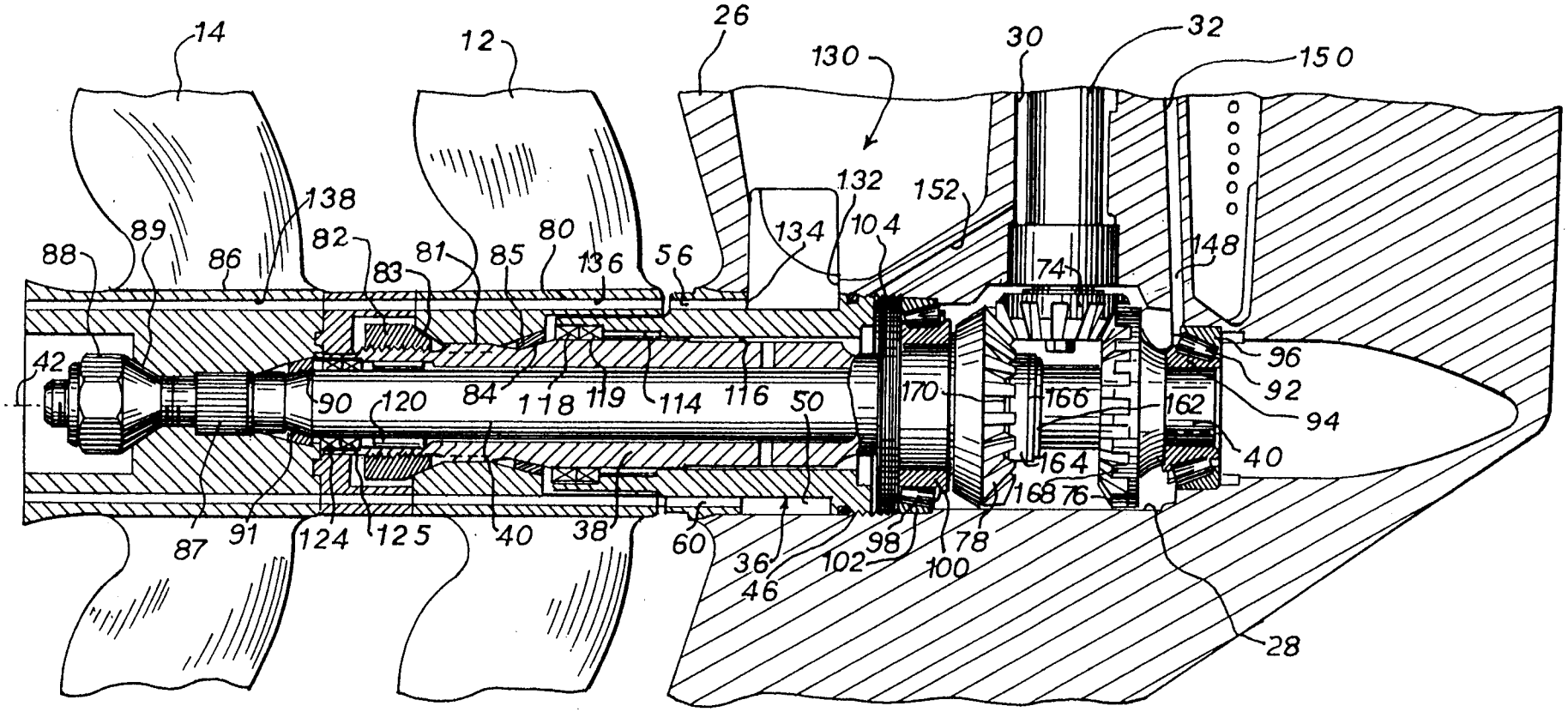
FIG. 2 is an enlarged partial sectional view of a portion of the structure of FIG. 1.
Figure 7:
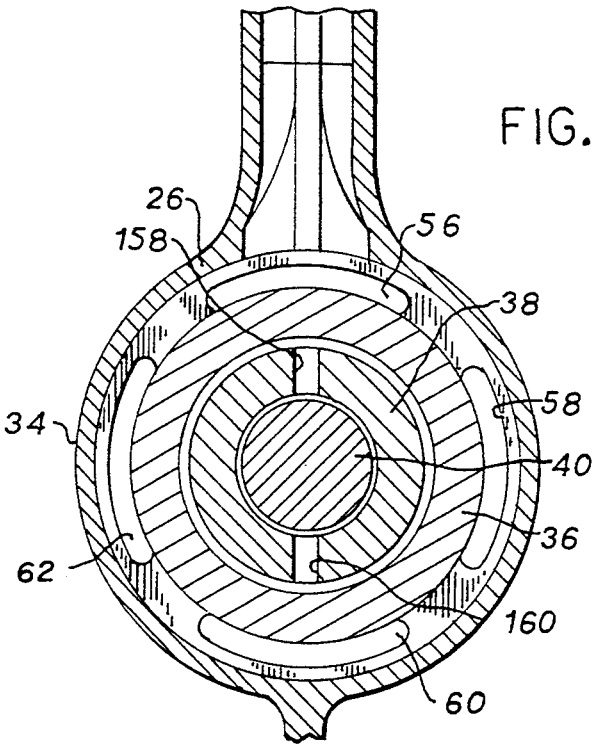
FIG. 7 is a sectional view taken along line 7—7 of FIG. 3.
Figure 8:
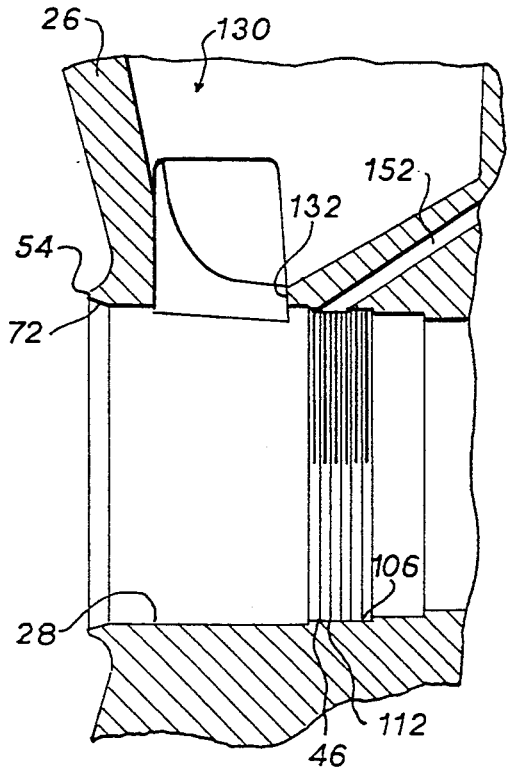
FIG. 8 is a section view of a portion of the structure of FIG. 3 with parts removed.
Figure 9:
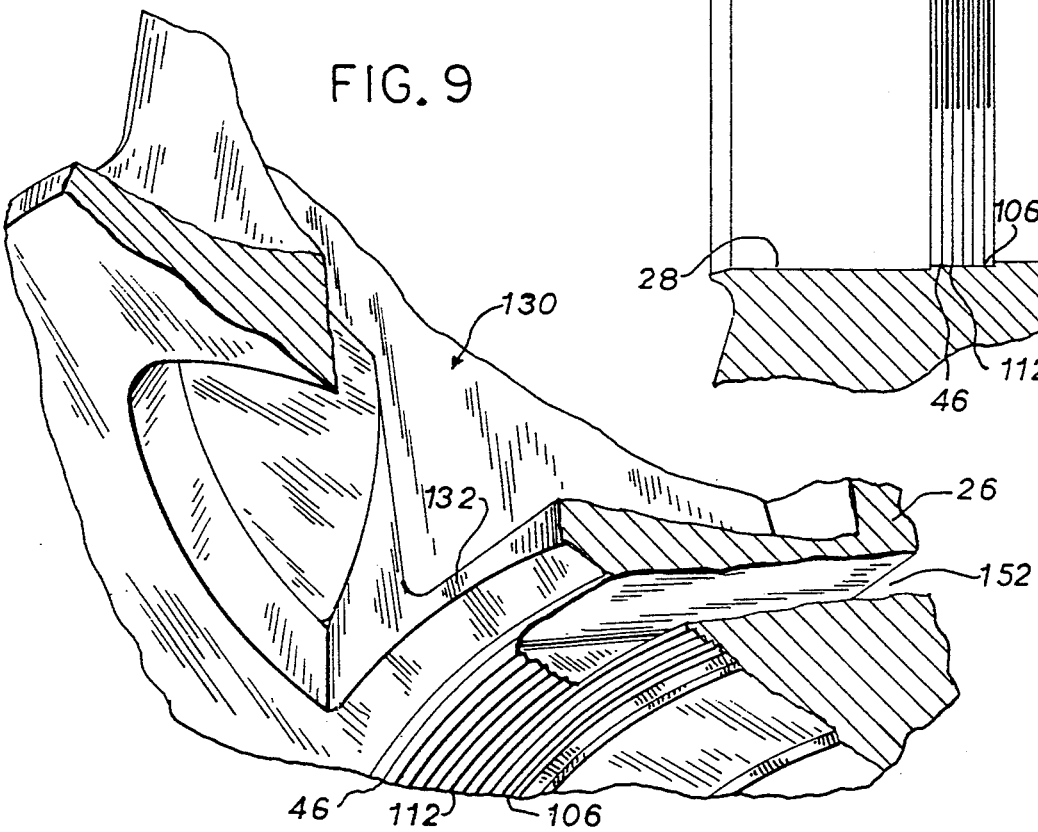
FIG. 9 is an enlarged perspective view of a portion of the structure of FIG. 8.

A pinion driving gear 74, FIG. 2, is mounted on the lower end of vertical drive shaft 32, as is standard. A first driven gear 76 is fixed on inner propeller shaft 40 in splined relation and is engaged by pinion gear 74 and drivingly rotates inner propeller shaft 40 in a first rotational direction. A second driven gear 78 is fixed on outer propeller shaft 38 in splined relation and is engaged by pinion gear 74 and drivingly rotates outer propeller shaft 38 in a second opposite rotational direction, as is standard. Self-centering mounting structure is provided for the propellers on each propeller shaft, as in incorporated allowed application Ser. No. 07/889,530, filed May 27, 1992, U.S. Pat. No. 5,249,995. Forward propeller 12 has a hub 80 mounted to outer propeller shaft 38 at splines 81 and is held thereon by threaded nut 82 and is axially engaged between and against tapered engagement surfaces 83 and 84 respectively on tapered nut 82 and tapered thrust hub ring 85 on outer propeller shaft 38. Tapers 83 and 84 provide a tight self-centering fit and mounting of the propeller to the propeller shaft. Splines 81 do not provide a tight fit, but merely rotational drive. Aft propeller 14 has a hub 86 mounted to inner propeller shaft 40 at splines 87 and is held thereon by threaded nut 88 and is axially engaged between and against tapered engagement surfaces 89 and 90 respectively on tapered nut 88 and tapered thrust hub ring 91 on inner propeller shaft 40. Tapers 89 and 90 provide a tight self-centering fit and mounting of the propeller to the propeller shaft. Splines 87 do not provide a tight fit, but merely rotational drive. In the preferred embodiment, spool 36 is mounted by left hand threads 46 in the housing, and forward propeller 12 is a left hand rotation propeller, and aft propeller 14 is a right hand rotation propeller.

A forward tapered roller thrust bearing 92 supports forward driven gear 76 in the housing, and includes an inner race 94 engaging gear 76, and an outer race 96 engaging housing 26 in bore 28. An aft tapered roller thrust bearing 98 supports aft driven gear 78 in the housing, and includes an inner race 100 engaging gear 78 and an outer race 102 engaging housing 26 in bore 28. A threaded locking ring 104, FIGS. 2 and 3, is thread mounted within horizontal bore 28 at thread set 106 and engages outer race 102 to prevent rearward movement of driven gear 78 and to adjust loading of same.

Thread set 46, mounting spool 36, FIG. 3, and thread set 106 mounting locking ring 104 are axially spaced such that the forward end 108 of spool 36 is spaced rearwardly of locking ring 104 by an axial gap 110 therebetween. Thread sets 46 and 106 may be separate threads, however it is preferred that they be provided by a continuous thread cut into horizontal bore 28 and having a forward portion at 106 for mounting locking ring 104, an aft portion at 46 for mounting spool 36, and a middle portion at 112 at axial gap 110. This enables a single machining threading operation to provide both thread sets 46 and 106.

A first aft bearing 114, FIGS. 2 and 3, within a first annulus 116 between outer propeller shaft 38 and spool 36 supports the outer propeller shaft for rotation within the spool. Annular seal 118 aft of bearing 114 prevents entry of water forwardly into annulus 116. Annular seal 119 prevents exit of lubricant rearwardly from annulus 116. A second aft bearing 120 in a second annulus 122 between inner propeller shaft 40 and outer propeller shaft 38 supports the inner propeller shaft for rotation within the outer propeller shaft. Annular seal 124 aft of bearing 120 prevents entry of water forwardly into annulus 122. Annular seal 125 prevents exit of lubricant rearwardly from annulus 122.

An engine exhaust passage 130, FIG. 2, is provided by a passage 132 in housing 26 communicating with horizontal bore 28 at spool 36. The exhaust passage continues at 134 through annular recess 50 provided by second outer diameter portion 48 of spool 36, and then rearwardly through slot passages 56, 58, 60, 62. The exhaust then passes rearwardly through hub exhaust passages 136 and 138 of the forward and aft propeller hubs 80 and 86. The exhaust passage at 134 includes a forward portion at recess 50 receiving exhaust from passage 130, and an aft portion at slots 56, 58, 60, 62 extending rearwardly from recess 50 toward and axially aligned with through-hub exhaust passages 136, 138. Third outer diameter portion 52 of spool 36 has an aft end 140, FIG. 6, defining an annulus facing axially rearwardly toward hub 80 of forward propeller 12. Fourth outer diameter portion 64 of spool 36 extends rearwardly within hub 80, and exhaust through hub 80 is concentric around fourth outer diameter portion 64. In the preferred embodiment, the plurality of arcuate slots 56, 58, 60, 62 have a cumulative area of at least about two square inches for a 502 cubic inch displacement engine. Further in the preferred embodiment, additional exhaust outlets from passage 130 are provided in the area of anti-cavitation plate 142, as is known, for additional exhaust relief if desired.

Positive pressure gradients at area 148, FIG. 2, provides an oil pumping function, for which further reference may be had to incorporated allowed application Ser. No. 07/892,399, filed May 28, 1992, U.S. Pat. No. 5,236,380, to circulate oil upwardly through oil passage 150 to upper gear mechanism 24, FIG. 1, which oil is returned through vertical bore 30. Housing 26 includes an oil passage 152, FIGS. 2, 3, 8, 9, extending from vertical bore 30 and communicating with horizontal bore 28 forwardly of exhaust passage 132. Oil passage 152 lubricates the dual propeller shaft assembly.

Spool 36 includes an annular groove 154 at first outer diameter portion 44, and has an annular O-ring seal 155, FIG. 3, in groove 154 and engaging housing 26 within horizontal bore 28 at a location axially between passages 132 and 152, and sealing passage 132 from passage 152, to thus prevent exhaust from entering the oil flow passages, and vice versa. Seal 156 is also axially between passage 132 and thread set 46. At least a portion of thread set 46 is axially between seal 156 and passage 152. Passage 152 communicates with horizontal bore 28 at axial gap 110. Oil passage 152 supplies oil to annulus 116 through gap 110, to lubricate bearing 114. Outer propeller shaft 38 has radial passages 158, 160 therethrough, providing oil passages supplying oil from annulus 116 to annulus 122 to lubricate bearing 120. Oil passages 158, 160 are spaced radially inwardly of exhaust passages 132, 50, 56, 58, 60, 62. Seal 156 is forward of oil passages 158, 160.

A thrust bearing 162, FIG. 2, engages between the propeller shafts such that thrust from outer propeller shaft 38 is transferred to inner propeller shaft 40 during rotation of the propeller shafts in opposite directions, as in incorporated allowed application Ser. No. 07/889,530, filed May 27, 1992, U.S. Pat. No. 5,249,995. Inner propeller shaft 40 extends through fore driven gear 76 and aft driven gear 78. Outer propeller shaft 38 extends through aft driven gear 78. Inner propeller shaft 40 has an annular shoulder 164 against which the thrust from outer propeller shaft 38 is transferred. Thrust bearing 162 is mounted between shoulder 164 and the forward axial end 166 of outer propeller shaft 38. Thrust bearing 162 is located axially between fore driven gear 76 and aft driven gear 78, such that thrust is transferred from outer propeller shaft 38 to inner propeller shaft 40 at an axial position on the propeller shafts located between gears 76 and 78. Inner propeller shaft 40 has a forwardly facing annular shoulder 168 engaging fore driven gear 76, such that the thrust is then transferred from inner propeller shaft 40 to fore driven gear 76 and then to tapered roller thrust bearing 92. The propeller shafts are allowed to slide fore and aft within their respective gears 76 and 78 along their respective splines, providing a floating shaft arrangement. Thrust bearing 162 is a double speed bearing and accommodates the opposite rotational directions of the propeller shafts. Snap ring 170 prevents rearward movement of shaft 40.

It is recognized that various equivalents, alternative and modifications are possible within the scope of the appended claims.

We claim:

1. A marine drive comprising:

a housing having a horizontal bore and an intersecting vertical bore therein;

a spool positioned in said horizontal bore;

a hollow outer propeller shaft positioned in said spool;

an inner propeller shaft positioned in said outer propeller shaft, said inner and outer propeller shafts being concentric and rotating in opposite rotational directions along a common axis;

a first exhaust passage comprising a passage in said housing communicating with said horizontal bore at said spool;

a second exhaust passage comprising a passage through said spool passing exhaust from said first exhaust passage rearwardly through said spool;

a forward propeller mounted to said outer propeller shaft;

an aft propeller mounted to said inner propeller shaft, one of said propellers being a right hand rotation propeller, the other of said propellers being a left hand rotation propeller, each propeller having a hub with through-hub exhaust passages passing exhaust from said spool rearwardly through said propeller hubs, wherein said spool comprises a cylindrical member comprising:

a first outer diameter portion engaging said housing within said horizontal bore;

a second reduced outer diameter portion within said horizontal bore and aft of said first outer diameter portion and defining an annular recess receiving exhaust from said first exhaust passage;

a third outer diameter portion aft of said second outer diameter portion and engaging said housing and having a plurality of slots extending rearwardly therethrough, such that exhaust from said annular recess flows rearwardly through said face through said third outer diameter portion then rearwardly through said hubs, and wherein said third outer diameter portion extends rearwardly externally of said horizontal bore and includes a raised annular shoulder of outer diameter greater than the inner diameter of said horizontal bore and engaging said housing at the aft end of said horizontal bore.

2. For the invention according to claim 1 wherein said spool comprises a fourth reduced outer diameter portion aft of said third outer diameter portion and external of said horizontal bore.

3. The invention according to claim 2 wherein said third outer diameter portion has an aft end defining an annulus facing axially rearwardly toward the hub of said forward propeller, said fourth outer diameter portion extends rearwardly within said hub of said forward propeller, exhaust through said hub of said forward propeller being concentric around said fourth outer diameter portion.

4. The invention according to claim 1 wherein said raised annular shoulder has a forward portion tapered forwardly to reduced outer diameters, and said horizontal bore has an aft end tapered rearwardly to increasing inner diameters and snugly engaging said forward tapered portion of said raised annular shoulder in flush relation.

5. The invention according to claim 1 wherein said slots comprise a plurality of arcuate slots having a cumulative area of at least about two square inches.

6. A marine drive comprising:

a housing having a horizontal bore and an intersecting vertical bore therein;

a vertical drive shaft positioned in said vertical bore;

a spool positioned in said horizontal bore;

an inner propeller shaft, and a hollow outer propeller shaft positioned concentrically over said inner propeller shaft to form a dual propeller shaft assembly, said dual propeller shaft assembly positioned in said spool, said inner and outer propeller shafts rotating in opposite rotational directions along a common axis;

a forward propeller mounted to said outer propeller shaft;

an aft propeller mounted to said inner propeller shaft, one of said propellers being a right hand rotation propeller, the other of said propellers being a left hand rotation propeller;

an exhaust passage comprising a first passage in said housing communicating with said horizontal bore at said spool;

an oil passage comprising a second passage in said housing communicating with said horizontal bore forwardly of said first passage and rearwardly of said vertical bore and lubricating said dual propeller shaft assembly.

7. The invention according to claim 6 wherein said spool includes an annular seal engaging said housing within said horizontal bore at a location axially between said first and second passage and sealing said first passage from said second passage.

8. The invention according to claim 7 wherein said spool is thread mounted by a set of threads within said horizontal bore, and wherein said annular seal is axially between said first passage and said set of threads.

9. The invention according to claim 8 wherein said set of threads is axially between said annular seal and said second passage.

10. A marine drive comprising:

a housing having a horizontal bore and an intersecting vertical bore therein;

a spool positioned in said horizontal bore;

an inner propeller shaft, and a hollow outer propeller shaft positioned concentrically over said inner propeller shaft to form a dual propeller shaft assembly, said dual propeller shaft assembly positioned in said spool, said inner and outer propeller shafts rotating in opposite rotational directions along a common axis;

a forward propeller mounted to said outer propeller shaft;

an aft propeller mounted to said inner propeller shaft, one of said propellers being a right hand rotation propeller, the other of said propellers being a left hand rotation propeller;

an exhaust passage comprising a first passage in said housing communicating with said horizontal bore at said spool;

an oil passage comprising a second passage in said housing communicating with said horizontal bore forwardly of said first passage and lubricating said dual propeller shaft assembly, wherein said spool is thread mounted within said horizontal bore at a first set of threads, and comprising:

a vertical driveshaft positioned in said vertical bore;

a pinion driving gear mounted on the lower end of said vertical driveshaft;

a first driven gear on said inner propeller shaft and engaged by said pinion gear and drivingly rotating said inner propeller shaft in a first rotational direction;

a second driven gear on said outer propeller shaft and engaged by said pinion gear and drivingly rotating said outer propeller shaft in a second rotational direction;

a tapered roller thrust bearing supporting said second driven gear for rotation in said housing, said tapered roller thrust bearing having an inner race engaging said second driven gear, and an outer race engaging said housing in said horizontal bore;

a threaded locking ring thread mounted within said horizontal bore at a second set of threads and engaging said outer race to prevent rearward movement of said second driven gear, wherein said first and second sets of threads are axially spaced such that said spool is spaced rearwardly of said locking ring by an axial gap therebetween, and wherein said second passage communicates with said horizontal bore at said axial gap.

11. The invention according to claim 10 wherein said first and second sets of threads comprise a section of threads cut in said horizontal bore and having a forward portion providing said second thread set, and aft portion providing said first thread set, and a middle section at said axial gap.

12. The invention according to claim 6 comprising:

a second exhaust passage comprising a passage through said spool passing exhaust from said first mentioned exhaust passage rearwardly through said spool, and wherein each propeller has a hub with through-hub exhaust passages passing exhaust from said spool rearwardly through said propeller hubs;

a first aft bearing in a first annulus between said outer propeller shaft and said spool and supporting said outer propeller shaft for rotation within said spool;

a second aft bearing in a second annulus between said inner and outer propeller shafts and supporting said inner propeller shaft for rotation within said outer propeller shaft;

wherein said oil passage supplies oil to said first annulus to lubricate said first aft bearing;

and comprising a second oil passage comprising a passage in said outer .propeller shaft supplying oil from said first annulus to said second annulus to lubricate said second aft bearing.

13. The invention according to claim 12 wherein said second oil passage is spaced radially inwardly of said second exhaust passage.

14. The invention according to claim 12 wherein said spool includes an annular seal sealing said first housing passage from said second housing passage at a location forward of said second oil passage.

15. A marine drive comprising:

a housing having a horizontal bore and an intersecting vertical bore therein;

a vertical drive shaft positioned in said vertical bore;

a spool positioned in said horizontal bore;

an inner propeller shaft, and a hollow outer propeller shaft positioned concentrically over said inner propeller shaft to form a dual propeller shaft assembly, said dual propeller shaft assembly positioned in said spool, said inner and outer propeller shafts rotating in opposite rotational directions along a common axis;

an exhaust passage comprising a first passage in said housing communicating with said horizontal bore at said spool;

said spool comprising a cylindrical member comprising:

a first outer diameter portion engaging said housing within said horizontal bore;

a second reduced outer diameter portion within said horizontal bore and aft of said first outer diameter portion and defining an annular recess receiving exhaust from said first housing passage;

a third outer diameter portion aft of said second outer diameter portion and engaging said housing and having a plurality of slots extending rearwardly therethrough;

a fourth reduced outer diameter portion aft of said third outer diameter portion and external of said horizontal bore;

a forward propeller mounted to said outer propeller shaft;

an aft propeller mounted to said inner propeller shaft, one of said propellers being a right hand rotation propeller, the other of said propellers being a left hand rotation propeller, each propeller having a hub with through-hub exhaust passages, such that exhaust from said annular recess flows rearwardly through said slots through said third outer diameter portion then rearwardly through said hubs;

an oil passage comprising a second passage in said housing communicating with said horizontal bore forwardly of said first housing passage and rearwardly of said vertical bore and lubricating said dual propeller shaft assembly.

16. A marine drive comprising:

a housing having a horizontal bore and an intersecting vertical bore therein;

a spool positioned in said horizontal bore;

an inner propeller shaft, and a hollow outer propeller shaft positioned concentrically over said inner propeller shaft to form a dual propeller shaft assembly, said dual propeller shaft assembly positioned in said spool, said inner and outer propeller shafts rotating in opposite rotational directions along a common axis;

an exhaust passage comprising a first passage in said housing communicating with said horizontal bore at said spool;

said spool comprising a cylindrical member comprising:

a first outer diameter portion engaging said housing within said horizontal bore;

a second reduced outer diameter portion within said horizontal bore and aft of said first outer diameter portion and defining an annular recess receiving exhaust from said first housing passage;

a third outer diameter portion aft of said second outer diameter portion and engaging said housing and having a plurality of slots extending rearwardly therethrough;

a fourth reduced outer diameter portion aft of said third outer diameter portion and external of said horizontal bore;

a forward propeller mounted to said outer propeller shaft;

an aft propeller mounted to said inner propeller shaft, one of said propellers being a right hand rotation propeller, the other of said propellers being a left hand rotation propeller, each propeller having a hub with through-hub exhaust passages, such that exhaust from said annular recess flows rearwardly through said slots through said third outer diameter portion then rearwardly through said hubs;

an oil passage comprising a second passage in said housing communicating with said horizontal bore forwardly of said first housing passage and lubricating said dual propeller shaft assembly, wherein:

said third outer diameter portion of said spool extends rearwardly externally of said horizontal bore and includes a raised annular shoulder of outer diameter greater than the inner diameter of said horizontal bore and engaging said housing at the aft end of said horizontal bore, said third outer diameter portion having an aft end defining an annulus facing axially rearwardly toward the hub of said forward propeller;

said fourth outer diameter portion extends rearwardly within said hub of said forward propeller, such that exhaust through said hub of said forward propeller is concentric around said fourth outer diameter portion of said spool;

said spool is thread mounted within said horizontal bore at a first set of threads;

and comprising:

a vertical drive shaft positioned in said vertical bore;

a pinion driving gear mounted on the lower end of said vertical driveshaft;

a first driven gear on said inner propeller shaft and engaged by said pinion gear and drivingly rotating said inner propeller shaft in a first rotational direction;

a second driven gear on said outer propeller shaft and engaged by said pinion gear and drivingly rotating said outer propeller shaft in a second rotational direction;

a tapered roller thrust bearing supporting said second driven gear for rotation in said housing, said tapered roller thrust bearing having an inner race engaging said second driven gear, and an outer race engaging said housing in said horizontal bore;

a threaded locking ring thread mounted within said horizontal bore at a second set of threads and engaging said outer race to prevent rearward movement of said second driven gear;

said first and second sets of threads being axially spaced such hat said spool is spaced rearwardly of said locking ring by an axial gap therebetween, said second housing passage communicating with said horizontal bore at said axial gap;

a first aft bearing in a first annulus between said outer propeller shaft and said spool at said fourth outer diameter portion and supporting said outer propeller shaft for rotation with said spool;

a second aft bearing in a second annulus between said inner and outer propeller shafts aft of said first aft bearing and supporting said inner propeller shaft for rotation within said outer propeller shaft;

wherein said oil passage supplies oil to said first annulus to lubricate said first aft bearing, and said outer propeller shaft has a passage therethrough supplying oil from said first annulus to said second annulus to lubricate said second aft bearing.

* * * * *

UNITED STATES PATENT AND TRADEMARK OFFICE

CERTIFICATE OF CORRECTION

PATENT NO. : 5,352,141

DATED : October 4, 1994

INVENTOR(S) : WAYLON D. SHIELDS ET AL

It is certified that error appears in the above-identified patent and that said Letters Patent is hereby corrected as shown below:

CLAIM 1, Col. 5, Line 63, after "said" delete "face" and substitute therefor -- slots --; CLAIM 7, Col. 6, Line 56, delete "passage" and substitute therefor -- passages --; CLAIM 16, Col. 10, Line 30, delete "hat" and substitute therefor -- that --; CLAIM 16, Col. 10, Line 37, delete "with" and substitute therefor -- within --.

Signed and Sealed this

Twenty-seventh Day of December, 1994

*Attest:*

Bruce Lehman

BRUCE LEHMAN

*Attesting Officer*

*Commissioner of Patents and Trademarks*